US005086768A

United States Patent [19]

Niemeyer

[11] Patent Number: 5,086,768

[45] Date of Patent: Feb. 11, 1992

[54] RESPIRATORY PROTECTIVE DEVICE

[75] Inventor: Trenton A. Niemeyer, St. Paul, Minn.

[73] Assignee: Filcon Corporation, St. Paul, Minn.

[21] Appl. No.: 433,381

[22] Filed: Sep. 15, 1989

Related U.S. Application Data

[63] Continuation of Ser. No. 18,154, Feb. 24, 1987, abandoned.

[51] Int. Cl.[5] ..... A62B 9/02

[52] U.S. Cl. ..... 128/205.24; 128/205.25; 128/206.15; 128/206.17; 128/206.27; 128/206.29; 128/207.11; 128/207.12; 128/205.29

[58] Field of Search ..... 128/207.22, 207.23, 128/207.28, 207.26, 201.28, 205.24, 205.28, 206.12, 206.18, 206.13, 206.2, 206.2 F, 207.12, 205.27, 205.28, 205.29

[56] References Cited

U.S. PATENT DOCUMENTS

| | | | |
|---|---|---|---|
| 2,318,790 | 5/1943 | Martindale | 128/207.11 |
| 3,643,686 | 2/1972 | Koegel | 128/207.12 |
| 3,805,778 | 4/1974 | Garrahan | 128/201.28 |
| 4,207,882 | 6/1980 | Lemere | 128/201.26 |
| 4,449,526 | 5/1984 | Elam | 128/206.21 |
| 4,470,413 | 9/1984 | Waracka | 128/201.18 |
| 4,674,492 | 6/1987 | Niemeyer | 128/206.15 |

*Primary Examiner*—Randall L. Green
*Assistant Examiner*—K. Reichle
*Attorney, Agent, or Firm*—James V. Harman

[57] ABSTRACT

The respiratory protective device minimizes dead space by locating the exhalation valve mechanism slightly spaced from, but directly in front of the mouth. The inhalation valve mechanism surrounds the streamlined flow path leading to the exhalation valve mechanism. The inhalation valve mechanism is located in a common chamber which receives filtered air from all filter assemblies. A chin support is provided which relieves any force to the gums and teeth as a result of the mouthpiece. Alternatively, a mechanism for forcing the wearer's lips closed around the mouthpiece to maintain a seal thereto is provided.

13 Claims, 5 Drawing Sheets

FIG. 2
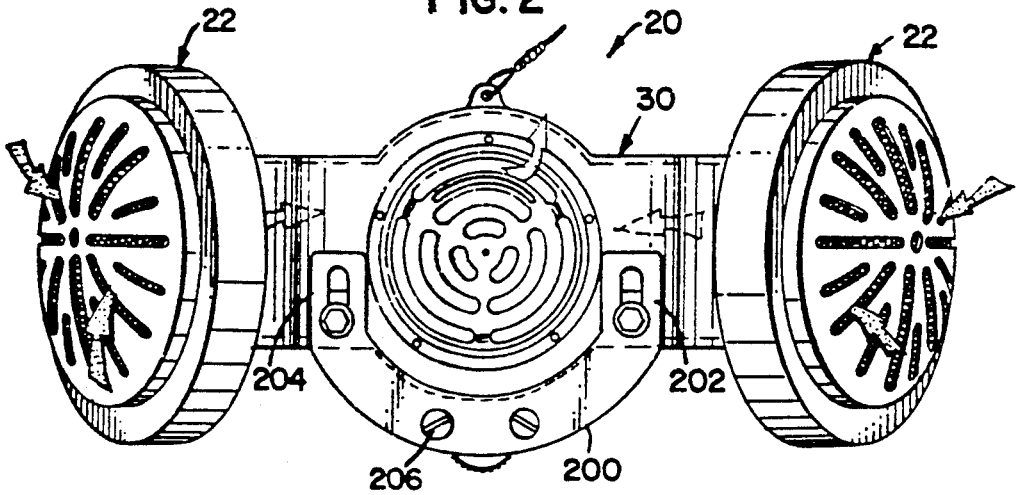
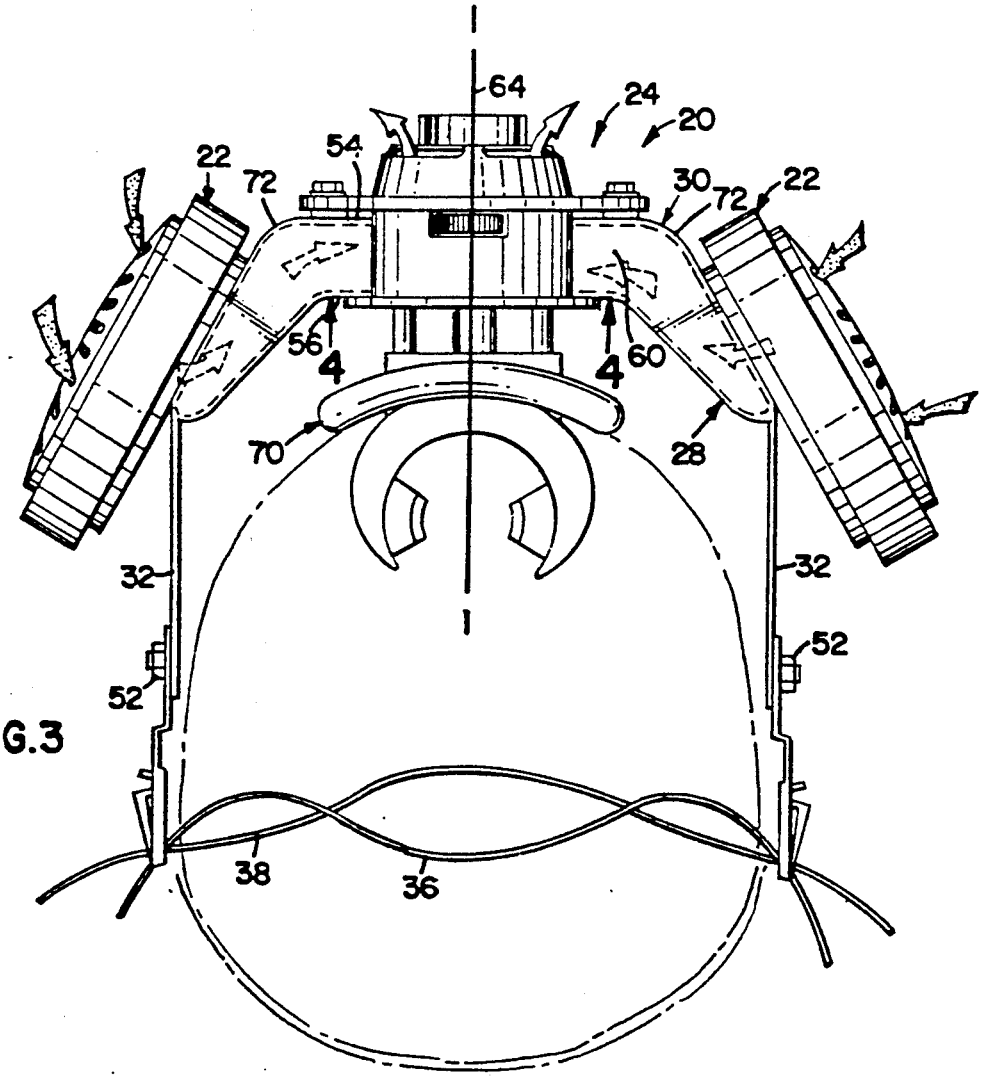
FIG.3

FIG.6
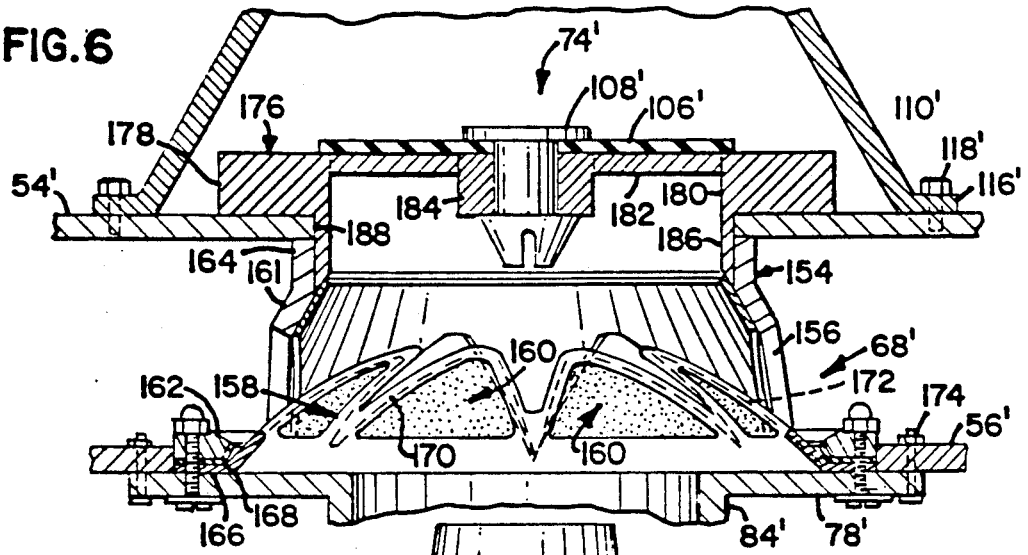
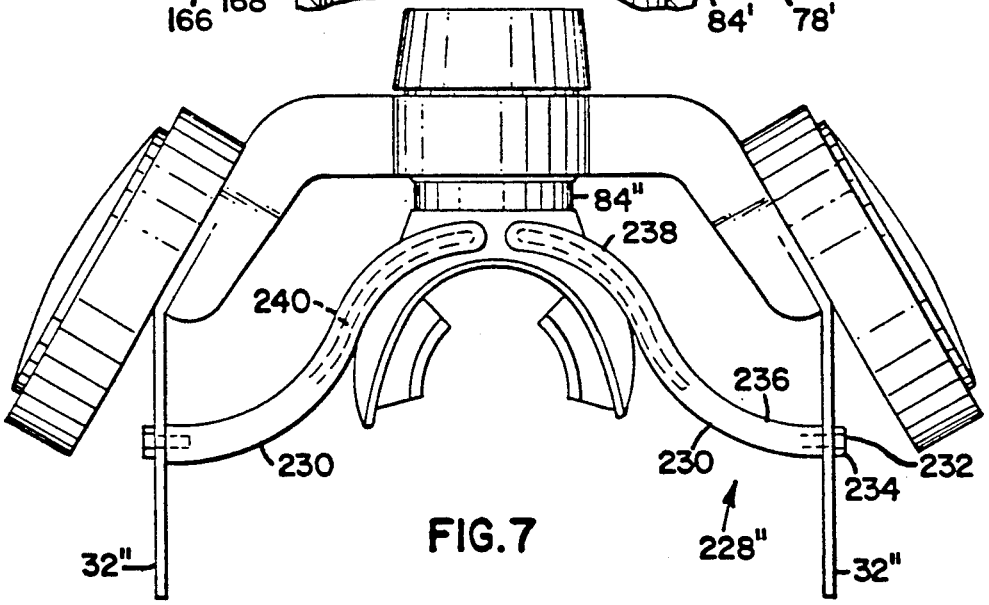
FIG.7
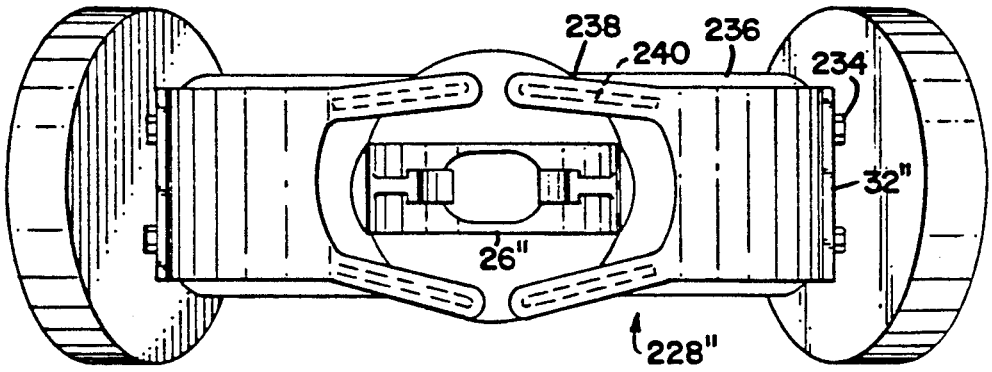
FIG.8

FIG. 9
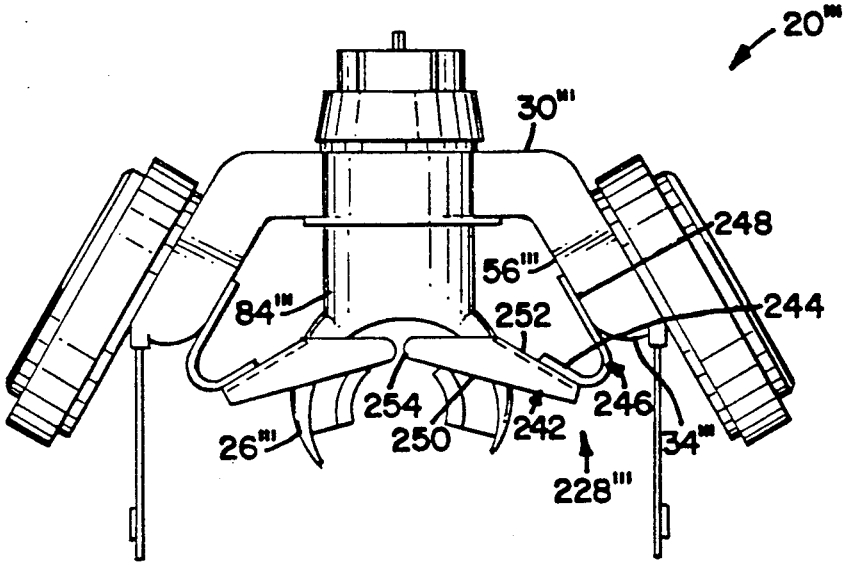
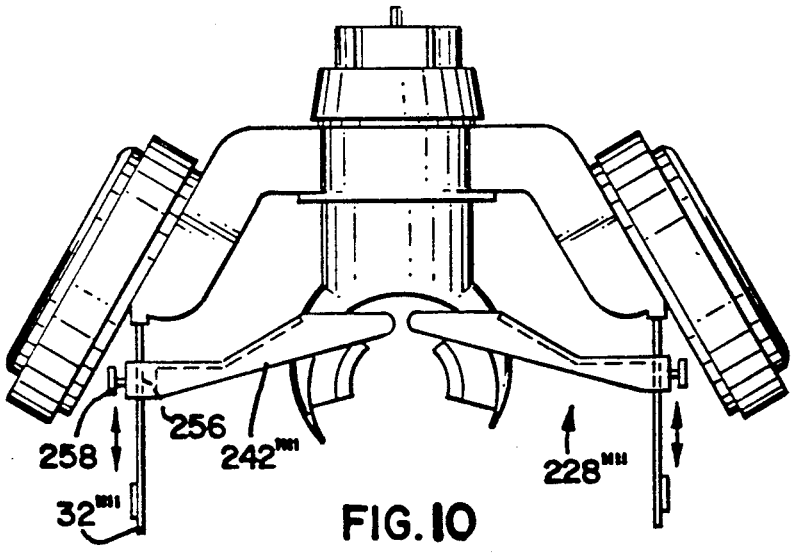
FIG. 10

RESPIRATORY PROTECTIVE DEVICE

This is a continuation of application Ser. No. 018,154, filed Feb. 24, 1987, now abandoned.

FIELD OF THE INVENTION

The present invention relates generally to breathing apparatus and, more particularly, to a respiratory protective device which is worn by a worker in a location where the air for breathing may be unsafe.

BACKGROUND OF THE INVENTION

Respiratory protective devices have been in use in the workplace for many years, particularly at work sites where sufficient engineering or work practice controls have not been possible or feasible. Governments have established regulations and monitored conditions. Although the regulations are designed toward giving maximum protection for the worker under a variety of conditions, investigations show that respirators generally are worn by a comparatively low percentage of those in need of respiratory protection. It has been found that this is principally due to a generalized discomfort experienced by workers who wear respirators. Frequently, respirators are worn only intermittently, primarily when air contamination is severe. As a consequence, the effectiveness of respirators in reducing work-related illness is much less than it should be. To a large extent, the lack of respirator wear is due to a need for design improvement.

Among the reasons which have been found leading to respirator discomfort and nonuse are that known respirators contain excessive dead space, that known respirator devices tend to exert undue pressure on sensitive areas of the face or inside the mouth, that known respirators leak, and that known valves in respirator devices deteriorate quickly.

The dead space problem is perhaps the most difficult. Respiratory dead space is the volume of air between a face mask and the face of the individual wearing the respirator. When the wearer exhales, part of the exhaled air is trapped inside the mask. During subsequent inhalation, the trapped air is rebreathed and enters the lungs first before any fresh air. If the dead space is large enough, it is possible that only the air inside the mask will be rebreathed. Because the partial pressure of carbon dioxide exhaled is higher than the partial pressure of carbon dioxide in atmospheric air, the reinhaled air which enters the lungs first contains elevated levels of carbon dioxide. This air mixes with the residue air remaining in the lungs during exhalation, and consequently, raises the level of retained carbon dioxide in the lungs.

One basic physiological response to increased carbon dioxide retention is hyperventilation, which is an increase in the minute volume of air breathed without a corresponding increase in metabolic activity, that is, work. Minute volume is the total volume of air inhaled in a minute. Minute volume is a function of tidal volume, which is the amount of air inhaled and exhaled in one breath and the number of breaths per minute. Initially, tidal volume increases to about 70% of the vital capacity of the person. Thereafter, breathing frequency rises.

If dead space is large enough, the partial pressure of carbon dixoide in the lungs can equal the venous partial pressure of carbon dioxide. At this point, diffusion ceases, and oxygen transfer between the lungs and blood stream is prevented. Continued metabolic demands increase arterial partial pressure of carbon dioxide. This stimulates chemical receptors in the brain and triggers muscular expansion of the lungs. As lung volume increases, more fresh air is inhaled, which mixes with the dead space air and reduces the total partial pressure of carbon dioxide entering the lungs. This compensatory mechanism is effective up to a concentration of carbon dioxide of about two percent of total volume by air. Further increases in carbon dioxide concentration, dependent upon time as well, produce symptoms of fatigue, dizziness, headache, ringing in the ears, drowsiness, paralysis of the respiratory center, and finally asphyxiation and death. The United States government has set limits of carbon dioxide concentration dependent upon exposure time as follows: 2.5% for 30 minutes or less, 2% for one hour, 1.5% for two hours, and 1% for four hours.

Some stability of this mechanism may be achieved while wearing a respirator under sedentary conditions. However, as exercising increases, the increased effort of the body to reequalize adds to the body work load. If the rate of exercising changes rapidly, the problem is magnified further.

Another physiological response to increased carbon dioxide retention is cardiac stress, and in particular, hypoxic pulmonary vasoconstriction. As the partial pressure of carbon dioxide increases, the partial pressure of oxygen correspondingly decreases. When the partial pressure of oxygen in the lungs and blood stream reach 103 millimeters of mercury, hypoxic pulmonary vasoconstriction begins. At that point, oxygen transfers between the lungs and the blood stream ceases. Because the body still needs oxygen, it will start using oxygen reserves in the blood. As this happens, the vascular walls contract, causing higher blood pressure.

Still another effect of increases retained carbon dioxide is diminishing capacity to perform work. Because the partial pressure of oxygen decreases as the partial pressure of carbon dioxide increases, total oxygen intake going to the lungs is decreased. As a result, the respirator wearer has to breath more air than he would without a respirator. Because every individual has a finite, maximum capacity of air which may be inhaled, the air required to compensate for the respirator is not available to support the increased metabolic demands of work.

Thus, it is clear that if workers are going to receive the benefit of wearing a protective respiratory device when it is otherwise unsafe not to do so, that the device must be designed with an effective dead space which does not lead to an excessive carbon dioxide concentration and the resultant discomfort and other problems mentioned. Known devices have not been effectively designed with this problem in mind.

With respect to the face or mouth discomfort problem, many protective devices are designed to include a mouthpiece which is placed inside the wearer's mouth. A common result with such devices is that the strap or other device which holds the respirator to the person's head draws or pulls the mouthpiece into the person's gums and teeth. Over a period of time, the gums are irritated and the teeth move which results in discomfort, poor bite, and other mouth problems.

A further problem which leads to workers deciding not to wear respiratory protective devices is the ineffective harness design. Considering the types of protective devices having a mouthpiece received within the mouth, such leakage occurs at the interface between the lips and the mouthpiece. A common time when such leakage occurs is when the wearer moves his jaw so that the bottom lip separates slightly from the mouthpiece.

Worker discomfort is also compounded by mask design and, in particular, inhalation valve flaps whose shapes are quickly distorted with use. Even the position of the mounting affects performance. Both conditions result in increased dead space and breathing resistance.

The present invention addresses these problems with structure designed to minimize the problems and which leads to greater comfort and safety for the wearer, and consequently a greater likelihood that the wearer will wear the protective device and realize its benefits.

SUMMARY OF THE INVENTION

The present invention is directed to a respiratory protective device including a mouthpiece, a cannister with an air filter therein, a mechanism for directing air from the filter to the mouthpiece, a mechanism attached to the directing mechanism for holding the mouthpiece with respect to the person's head, and a mechanism for selectively passing filter air and exhalation air. The directing mechanism includes spaced-apart fore and aft walls. The aft wall has an opening in line with exhalation air flowing from the mouthpiece. The passing mechanism includes a first valve mechanism for admitting filtered air from the filter to the mouthpiece and a second valve mechanism for outletting exhalation air from the mouthpiece to ambient. The first valve mechanism includes closure members and a support frame for the closure members which surround a streamline flow path between the opening in the aft wall of the directing mechanism and the second valve mechanism in the region between the fore and aft walls of the directing mechanism. In this way, space common to both filtered air flow and exhalation air flow is minimized.

In an embodiment having a plurality of filter assemblies, the directing mechanism includes a common chamber which receives air from all the filter assemblies before passing the air through the first valve mechanism to the mouthpiece for inhalation.

These embodiments provide for a minimizing of equipment dead space. Essentially, the second valve mechanism for passing exhalation air is directly in front of, but spaced somewhat outwardly from the front of the mouth. The first valve mechanism which admits filtered air for inhalation is located between the mouth and the second valve mechanism and preferably includes a support frame with a plurality of closure members which surround the streamline flow path between the mouth and the second valve mechanism. With such structure, it has been found that the dead space for the present protective device can be limited to about 33 milliliters. Such volume is substantially below the 100 milliliter level identified by the United States government.

In addition, since the valve mechanisms are in such close proximity to and provide for such unimpeded flow paths, the resistance to air movement which may be experienced by the wearer is minimized. In this regard, because the equipment dead space is so small, it takes a minimal amount of air during exhalation to build sufficient pressure to operate the second valve mechanism to pass exhalation air. Furthermore, due to the common chamber, i.e., the concept of surrounding the streamline flow path to the second valve mechanism with closure members for the first valve mechanism, a minimal amount of air needs to be inhaled before creating the necessary pressure differential for functioning the closure members of the first valve mechanism.

In a further embodiment, the present invention includes a mechanism for forcing the wearer's lips closed around the connecting passageway between the mouthpiece and the aft wall of the directing mechanism. Such forcing mechanism may assume a variety of forms and is preferably adjustable.

In still a further embodiment, the protective device includes a mechanism for holding the device on the wearer's head such that a first force is directed toward pushing the mouthpiece into the wearer's teeth and gums. The device further includes, however, a reaction mechanism for exerting a second force in a direction generally counter to the first force to relieve the wearer's teeth and gums from the first force. The reaction mechanism is attached to the frame of the protective device and contacts the wearer's face external of his mouth. More particularly, the reaction mechanism preferably engages the wearer's chin. In this way, movement by the person of his chin causes the engaging or reaction mechanism and the mouthpiece, as well as the rest of the protective device connected to the frame, to move with the person's chin thereby minimizing the likelihood of leakage between the lips of the wearer and the mouthpiece when the wearer moves his chin within reasonable limits.

The present invention, thus, addresses simply, but effectively, many problems which have existed with known respiratory protective devices. The invention results in a device which is comparatively comfortable to wear and which should not lead to the degree of discomfort and nonuse as is the case with known devices due to the problems discussed hereinbefore.

For a better understanding, these advantages and objectives of the present invention will be more fully apparent by reference to the drawings, briefly described hereinafter, and the detailed description of the preferred embodiment which follows thereafter.

BRIEF DESCRIPTION OF THE DRAWINGS

FIG. 2 is a front view of the device of FIG. 1, with the nose clip removed;

FIG. 3 is a bottom view of the device of FIGURE 2, showing a person's head in broken lines;

FIG. 6 is a cross-sectional view, similar to FIG. 5, of an alternate embodiment;

FIG. 7 is a top view of a protective device in accordance with the present invention showing one embodiment of a mechanism for forcing the wearer's lips closed around the mouthpiece;

FIG. 8 is a rear view of the device of FIG. 7;

FIG. 9 is a top view, similar to FIG. 7, of an alternate embodiment; and

FIG. 10 is a top view, similar to FIGS. 7 and 9, of another alternate embodiment.

DETAILED DESCRIPTION OF THE PREFERRED EMBODIMENT

Figure 1:
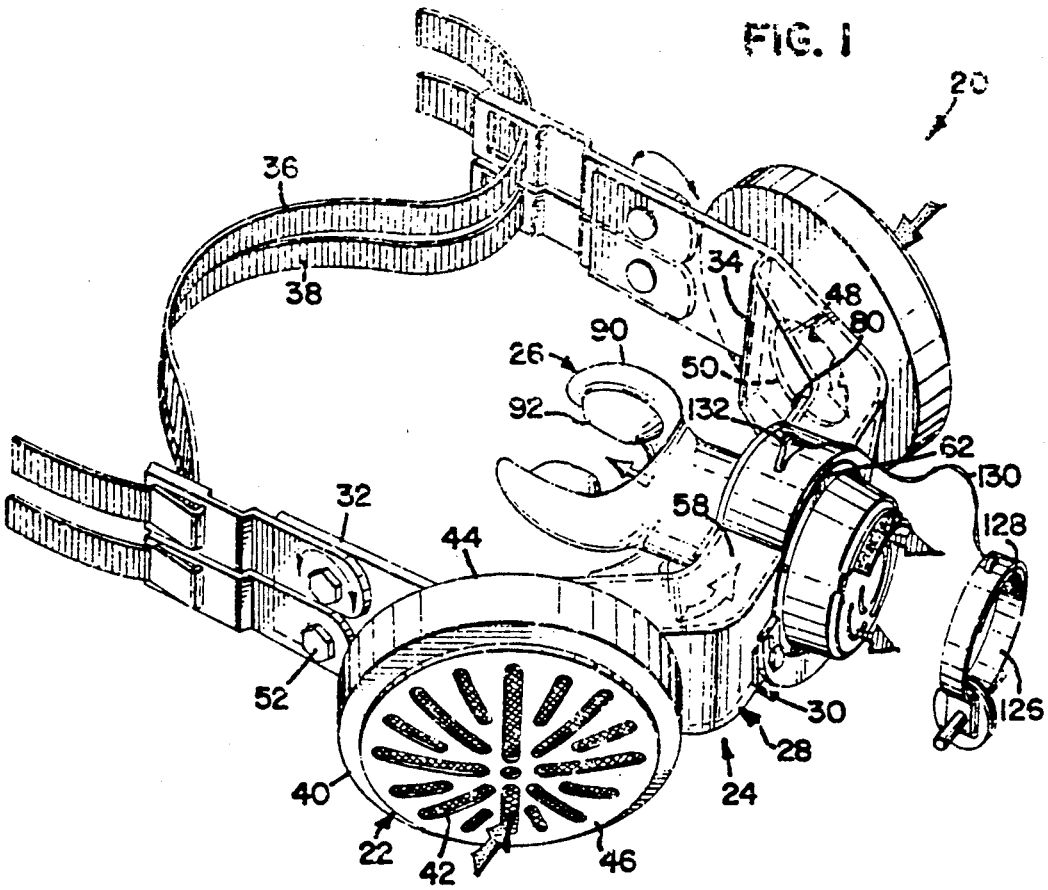
FIG. 1 is a perspective view of a respiratory protective device in accordance with the present invention.

Referring now to the drawings wherein like reference numerals designate identical or corresponding parts throughout the several views, and wherein like reference numerals, only primed, designate identical or corresponding parts in views of alternate embodiments, and referring more particularly to FIG. 1, a respiratory protective device in accordance with the present invention is designated generally by the numeral 20. Device 20 includes a pair of filter assemblies 22 opening into an air directing mechanism 24 leading to a mouthpiece 26. The air directing mechanism 24 includes a rigid frame 28 having a walled passageway 30 with plate-like extensions 32 extending rearwardly along the wearer's head from each end 34 of the walled passageway 30. A pair of adjustable straps 36 and 38 are rotatably fastened at opposite ends to a different extensions 32.

Assemblies 22 include a cannister 40 which holds a filter 42. The filter is commercially available and is selected to remove particular contaminents depending on the environment in which the protective device is likely to be used. The cannister is not shown in detail since its details are not important to the present invention. The cannister, however, preferably includes a base 44 and a cover 46. The cover snaps or screws or is otherwise removable with respect to the base so that the filter may be replaced when appropriate. The base 44 has an opening 48 in the back wall opposite the cover 46. Opening 48 is aligned with a similar opening 50 in the outer or fore wall 54 of walled passageway 30. In this way, air enters through the vents in cover 46 as indicated by the darkened arrows. The air passes through the filters and out openings 48 and 50 before being directed along the walled passageway 30 as indicated by the clear arrows. Base 44 is fastened by adhesive, screwed, or otherwise attached to walled passageway 30 so that openings 48 and 50 remain in alignment to allow the air flow as indicated.

Frame 28 is rigid so as to hold various elements in a constant relationship with respect to one another. As indicated, frame 28 includes walled passageway 30 and extensions 32 which extend along the wearer's head toward the rear of his head from the ends 34 of walled passageway 30. The opposite ends of straps 36 and 38 are rotatably attached to extensions 32 with rivets, nut and bolt combinations, or other similar fastening mechanism 52. Rigid frame 28 in combination with straps 36 and 38 hold mouthpiece 26 with respect to the wearer's head. Straps 36 and 38 extend around the wearer's head from one end of main frame 28 to the other. Apparatus 20 advantageously may include a pair of straps as shown so that one of straps 36, 38 may be rotated up to an angle of 90 degrees with respect to the other so that it may extend over the top of the wearer's head while the other strap may extend around behind the wearer's head. As shown in FIG. 3, extensions 32 are spaced-apart sufficiently so that the wearer's head will fit between them without contacting them so as to avoid applying an unnecessary pressure to the head.

Wall passageway 30 may be configured in a variety of shapes. Wall passageway 30 comprises the primary component of the rigid frame 28. Wall passageway 30 has fore and aft walls 54, 56 which are substantially perpendicular to the wearer's mouth. Forward wall 54 is spaced outwardly farther from the wearer's mouth than aft wall 56. Top and bottom walls 58, 60 are shaped similarly and generally extend between fore and aft walls 54, 56 to form an enclosed passageway. The portion 62 of walled passageway 30 which is centered on centerline 64 of device 20 is preferably cylindrical at the top and bottom so as to form a common chamber 66 (see FIG. 5) about first valve mechanism 68 which admits filtered inhalation air. Walled passageway 30 extends in opposite directions sidewardly from cylindrical portion 62 sufficiently far to provide necessary flat surfaces for attachment of the chin engaging mechanism 70 discussed hereinafter. Then, walled passageway 30 on each side has a bend 72 to form an obtuse angle to extend rearwardly thereby conforming in a general way to the curvature of the wearer's head. From bend 72 on both sides of centerline 64, walled passageway 30 extends rearwardly sufficiently far to provide for attachment of filter assemblies 22 and the alignment of opening 48 in base 40 of assembly 22 and opening 50 in walled passageway 30. The ends 34 of walled passageway are spacedapart approximately the width of a person's head so that extensions 32 can be attached to ends 34 in a parallel fashion and still be spaced sufficiently to receive therebetween the head of most wearers without contacting said wearer's head. As indicated, walled passageway 30 is fully enclosed except at openings 50 and at the openings in cylindrical portion 62 as described hereinafter.

Figure 4:
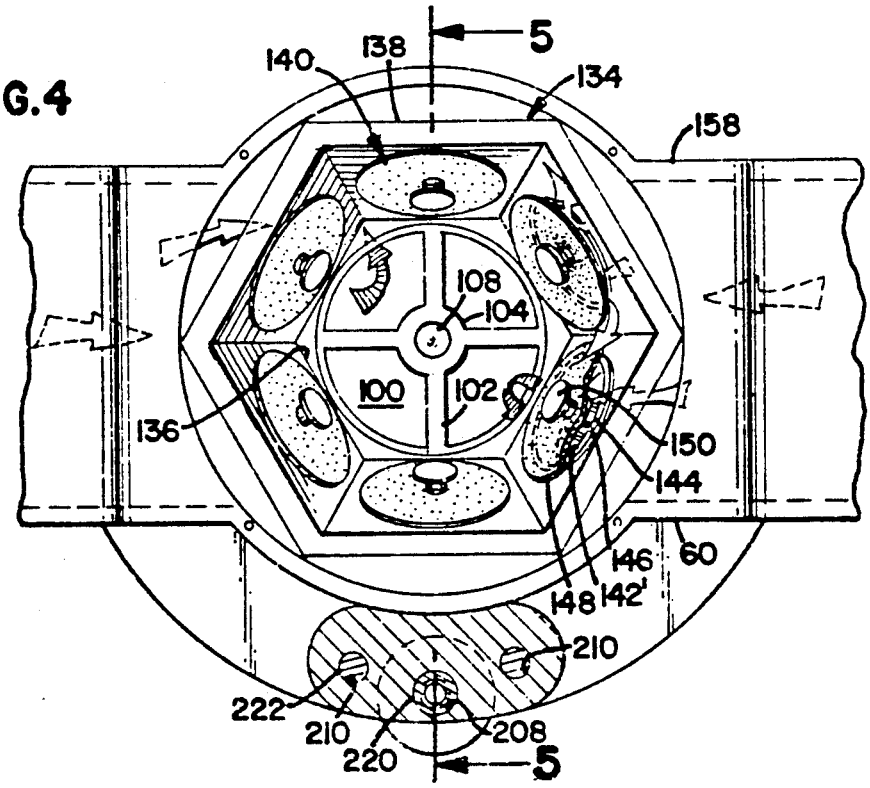
FIG. 4 is a cross-sectional view taken along line 4—4 of FIG. 3.
Figure 5:
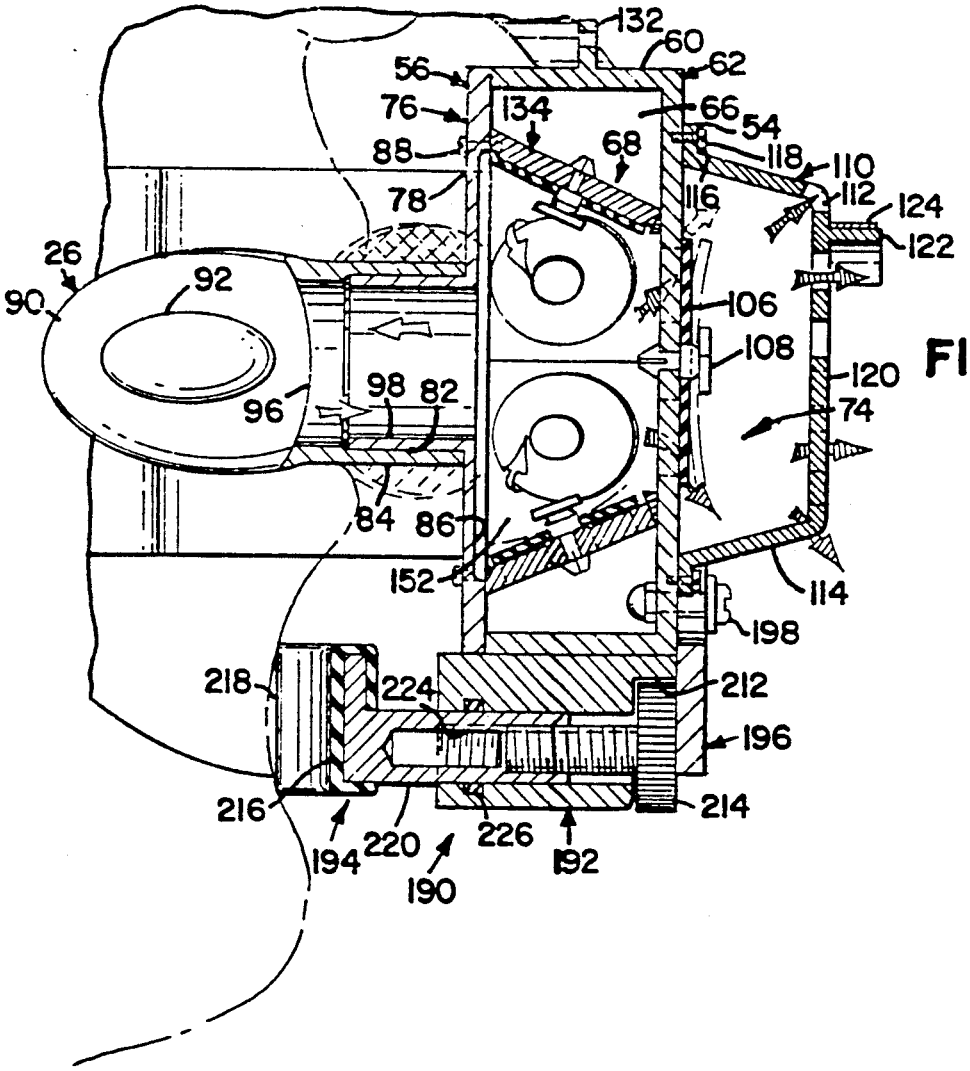
FIG. 5 is a cross-sectional view taken along line 5—5 of FIG. 4.

As shown in FIGS. 4 and 5, mouthpiece 26, first valve mechanism 68, and second valve mechanism 74 are all attached to frame 28 at cylindrical portion 62. In the region of cylindrical portion 62, aft wall 56 includes an attached member 76. Member 76 includes a disk-like central portion 78 for forming a portion of aft wall 56 and the back of central portion 62. Member 76 also has sidewardly extending plate portions 80 (see FIG. 1). A cylindrical tubular portion 82 extends rearwardly from central portion 78 for a short distance to receive a mating cylindrical portion 84 of mouthpiece 26. Portion 82 is centered on cylindrical portion 62. The hollow interior of portion 82 forms a connecting passageway 98 between mouthpiece 26 and space internal to first valve mechanism 68 within walled passageway 30. The forward wall of central portion 78 may have a recess 86 to allow for proper functioning of first valve mechanism 68. Member 76 is attached to the walls of walled passageway 30 with screws 88 or other fastening mechanism, such as an adhesive.

Mouthpiece 26 is preferably made from a mildly hard rubber. Mouthpiece 26 is shaped in the form of a wall 90 to fit between a person's teeth and lips which wraps around said person's teeth from one side to the other. Wall 90 is also slightly arcuate in the up and down dimension of a person's face. Extending inwardly from opposite sides of wall 90 are a pair of members 92 for fitting between upper and lower teeth to allow a person to bite thereon and better hold mouthpiece 26. Cylindrical portion 84 extends forwardly from wall 90 so that a person's lips fit around cylindrical portion 84 and form a seal thereon. Mouthpiece 26 includes an opening 96 which is substantially centered with respect to the wearer's mouth. Preferably, the centerline of opening 96 is the same as centerline 64. In this way, opening 96 forms the entrance to connecting passsageway 98. As discussed further hereinafter, second valve mechanism 74 is also aligned along centerline 64 and is thus also aligned with opening 96 and passageway 98.

First valve mechanism 68 admits filtered air for inhalation, while second valve mechanism 74 allows exhalation air to escape to ambient. Considering second valve mechanism 74 first, it is located and attached to fore wall 54 directly in line with connecting passageway 98. Second valve mechanism 74 includes a circular opening 100. A plurality of spokes 102 extend from the edge of opening 100 inwardly to a central hub 104. A closure member 106 is attached with a fastening insert 108 or other fastening mechanism, such as a nut and bolt combination. Closure member 106 is preferably made from a flexible rubber and is large enough to completely cover opening 100. Closure member 106 is normally closed so that when exhalation air is blown against it, member 106 flexes outwardly to allow the exhalation air to escape into space enclosed by cover 110.

Cover 110 protects second valve mechanism 74 and is formed to have a frusto-conical wall 114 with a flange 116 for attachment with screws 118 or other fastening mechanism site end of wall 114 as flange 116. Wall 120 includes a plurality of openings 112 to allow exhalation air to pass therethrough into the ambient air external of device 20. A ledge 122 is formed on wall 120. Ledge 122 includes a strip 124 of hook and loop material. Ledge 122 supports a nose clip 126, as shown in FIG. 1. Clip 126 includes a mating strip of hook and loop material 128. A cord 130 further fastens clip 126 to a tab 132 at the top of central portion 62.

First valve mechanism 68 includes a transverse wall 134 which extends between fore wall 54 and member 76 which forms a part of aft wall 56. Transverse wall 134 may be a separate member attached to central portion 78 or it may be a unitary part of member 76 extending forwardly from portion 78. Wall 134 is formed to be multi-sided and inclined inwardly as it proceeds toward fore wall 54. The forward opening 136 of wall 134 is larger than and completely exposes opening 100 of second valve mechanism 74. The converging shape of wall 134 helps direct exhalation air toward second valve mechanism 74. Each side 138 of wall 134 includes a center pinned flap valve 140 similar to second valve mechanism 74, only smaller. Each side 138 includes an opening 142 having a plurality of spokes 144 extending inwardly to a central hub 146. A closure member 148, similar to member 106 only smaller, is pinned with a fastening insert 150, similar to fastener 108. It is noted that transverse wall 134 and the valve openings 142 are nonparallel to the flow of exhaled air along centerline 64 from passageway 98 and through space 152. As a consequence, closure members 148 will close more easily, even under turbulent air flows than a system wherein the wall containing the valve is parallel to air flow.

Transverse wall 134 fits within cylindrical portion 62 so that a common chamber 66 is formed between the two structures. Filtered air from filter assemblies 22 then flows, fills and mixes in common chamber 66 before being drawn through any of valves 140 into space 152 interior of first valve mechanism 68. During inhalation, a negative pressure is formed in space 152 so that valve mechanism 74 closes and closure members 148 flex away from openings 142. During exhalation, a positive pressure forms in space 152 and closure members 148 are forced against wall 134 to close all openings 142, while positive pressure flexes closure member 106 outwardly to allow flow through opening 100 as indicated hereinbefore. The regular arrangement of valves 140 about centerline 64 and about the streamline flow path between mouthpiece 26 and second valve 74 insures that all of valves 140 function approximately at the same time and approximately to the same degree thereby keeping the pressures necessary for functioning valves 140 at a minimum.

It is noted that the total dead space of device 20 comprises space 152 within frame 134 and the space in connecting passageway 98. Since connecting passageway 98 is short and since first valve mechanism rather closely surrounds the streamline flow path between connecting passageway 98 and second valve mechanism 74, the dead space is minimal. In a prototype device, the dead space was measured to be about 33 milliliters. In this regard, it is noted that the distance between fore and aft walls 54, 56 is made no greater than necessary for the proper functioning of valves 140. Valves 140 must be sufficiently large to admit the maximum quantity of air which may be needed for inhalation in the time period of an inspiration. Similarly, second valve mechanism 74 is sufficiently large to provide an outlet for a maximum quantity of exhaled air during the time of an expiration.

An alternate embodiment 68' for first valve mechanism 68 is shown in FIGS. 6. First valve assembly 68' includes a transverse wall 154 with regularly arranged openings 156 therein. A support frame 158 fits within transverse wall 154 so that closure members 160 are normally in contact with transverse wall 154 to close openings 156, but when they flex open, they are supported by support structure 158, rather than continuing to flex and contact portion 78'. Transverse wall 154 has a frusto-conical portion 161 with a flange 162 at the larger end and a cylindrical extension 164 at the smaller end. Flange 162 is fastened to portion 78' with a plurality of nut and bolt combinations 166 or other fastening mechanism. Similar flanges 168 and 170 of support frame 158 and closure member 160, respectively, are sandwiched between flange 162 and portion 78' so as to fasten them also with respect to portion 78' and back wall 56'. As indicated, a plurality of openings 156 are formed in frustoconical portion 161. Each opening 156 is preferably triangular with the base nearer back wall 56'. Cylindrical portion 164 is sufficiently long to extend from portion 161 to fore wall 54'.

Support frame 158 includes a plurality of regularly arranged triangular frames 170 extending from flange 166 inwardly with respect to frusto-conical portion 161 and toward fore wall 54'. Support frame 158 is open between each triangular frame 170, and each triangular frame 170 is likewise open. In this way, triangular frames 170 simply support the outer edges of flaps 172 of closure members 160. Exhalation air may readily pass through triangular frames 170 to force flaps 172 against transverse wall 154 and close openings 156. On the other hand, support frame 158 is available to prevent filtered air from forcing flaps 172 too far away from transverse wall 54 during inhalation so that they would not readily return for closure of openings 156 during exhalation.

Closure member 160, as indicated, comprises a ringular flange 158 with a plurality of triangular flaps 172 extending inwardly and forwardly therefrom. Each flap 172 is sufficiently large to cover an opening 156. Openings 156, flaps 172, and triangular frames 170 are all regularly arranged and aligned in order to function as indicated.

In addition, FIG. 6 shows portion 78' fastened to back wall 56' at nut and bolt combinations or other fastening mechanism 174 to further complete back wall 56'. Also, an insert 176 for holding second valve mechanism 74' is shown. Insert 176 is essentially a disk 178 with an opening 180. A plurality of spokes 182 extend inwardly to a central hub 184 which receives fastening insert 108' to hold closure member 106' in the fashion described hereinbefore. A cylindrical sleeve 186 extends rearwardly from ring portion 178 for a friction fit within an opening 188 in fore wall 54' and within cylindrical portion 164 of transverse wall 154. Adhesive or some other fastening mechanism may be used to provide a more secure attachment for insert 176.

Apparatus 20, as shown in FIGS. 1-5, includes a further feature not yet described. With particular reference to FIG. 5, a chin support 190 is shown. Chin support assembly 190 includes a guide block 192 and an adjustable support 194. A bracket 196 is fastened with nut and bolt combination 198 on opposite sides of cover 110. Bracket 196 is plate-like in a plane parallel with fore wall 54 and has an arcuate portion 200 so as to curve around beneath cover 110. Legs 202 extend from opposite sides of arcuate portion 200 to fit against the outside of fore wall 54. Slotted openings 204 in legs 202 receive the bolt of nut and bolt combinations 198. Guide block 192 is held to bracket 196 by screws 206 in a location centered with respect to device 20 and beneath central cylindrical portion 62. Guide block 192 is elongated in a direction parallel with fore and aft walls 54, 56 and has a length approximately equal with the separation between fore and aft walls 54, 56. Guide block 192 includes an opening 208 centered with respect to device 20 and somewhat smaller openings 210 on opposite sides of opening 208. The forward end of opening 208 has an enlarged diameter portion 212 which opens through the bottom side of guide block 192 to expose thumb screw 214.

Support 194 includes an arcuate wall 216 for conforming with the indented or creased portion of a person's chin. A pad 218 is fitted over wall 216 to provide a more comfortable contact with the chin. A central post 220 extends forwardly from wall 216 to fit within passage 208. Additional posts 222 on opposite sides of central post 220 also extend forwardly as guides and fit within passages 210. Post 220 includes a threaded passageway 224 extending rearwardly from its forward end to near wall 216. Thumb screw 214 is threaded into threaded passageway 224 so that when it is rotated, it moves support 194 toward or away from guide block 192. It is preferable to use an 0-ring 226 in an appropriate groove in the wall of passageway 208 to provide friction with respect to the movement of support 194. Thus, chin support 194 is adjustable with respect to the rest of device 20 and moves in a direction generally parallel with the connecting passageway 98 of mouthpiece 26.

Chin support 190 functions as a reaction mechanism to provide a second force in a direction generally counter to a first force directed toward pushing mouthpiece 26 into the teeth and gums of the wearer of device 20. In this way, the teeth and gums are protected and a significant source of discomfort for the wearer is neutralized.

A further advantage of chin support 190 is that it allows device 20, except for straps 36 and 38, to be moved in concert with the wearer's chin. That is, chin support 190 is rigidly attached to walled passageway 30. Walled passageway 30 is a part of rigid frame 28 to which the other components of device 20 are also attached as described. Thus, all of device 20 except for the flexibility of mouthpiece 26 and the rotation of straps 36 and 38 with respect to extensions 32 is rigid. Therefore, when the wearer moves his chin, wall 194 moves with it as does the rest of the rigid portion of device 20. The wearer can easily compensate with his lips to maintain a seal about the connecting portion 84 of mouthpiece 26. Known devices do not provide for a chin support and do not allow the protective device to move with movement of the chin. Consequently, occasionally, a wearer finds it necessary to move his chin and cannot compensate sufficiently with just his lower lip so that the seal is broken and a safety hazard created. The present chin support feature in combination with the head harness solves this problem. That is, as indicated, the device moves with the chin support so that both the upper and lower lips are allowed to compensate for the jaw opening. Also, the chin support applies a force directed to closing the jaw. This tends to remind the wearer of the danger and further to make it increasingly difficult for the wearer to widen the separation of his jaw. Furthermore, as the jaw relaxes after yawning or otherwise opening the force of the chin support works in a direction to close the jaw.

As shown in FIGS. 7-10, a mechanism for forcing the wearer's lips closed around the connecting portion 84" of mouthpiece 26 may be used as an alternative to chin support 190. The forcing mechanism 228", as shown FIGS. 7-8 includes ductal, finger-like members 230 which extend along opposite sides of the wearer's face from the opposite extensions 32". One end 232 of each member 230 is fastened with a screw 234 or other attachment mechanism to extension 32" Member 230 includes a solid, rather rigid portion 236 near extension 32" and fingers 238 which fit above and below the perioral area formed by the lips of the person wearing the protected device. Fingers 236 include a ductal element 238 so that the fingers may be shaped to conform to the person's face so as to apply as much force as desired to close the lips against the connecting portion 84 of mouthpiece 26".

An alternate embodiment 228''' of lip forcing mechanism 228 is shown in FIG. 9. A pair of contact members 242 are attached to one end 244 of a leaf spring 246. The other end of leaf spring 246 is adhesively or otherwise attached to the inside or aft wall 56''' near end 34''' of wall passageway 30'''. Leaf spring 246 has a U-shape so when ends 244 and 248 are compressed toward one another, contact member 242 applies force to the wearer's lips to aid the wearer in maintaining a seal around portion 84''' of mouthpiece 26'''.

There is a leaf spring 246 on each side of device 20'''. Therefore there are two sets of pairs of contact members 242. In each set of contact members 242 one is located to contact the face in the region of the upper lip, while the other is located to contact the face in the region of the lower lip. In this way, a contact member 242 applies force on both the upper and lower lips on both sides of the face. It is noted that FIG. 9 is a top view and that the lower contact member 242 of each set of contact members is not shown in that view.

Each contact member 242 has either a flat or an arcuately shaped surface 250 to make contact with the face. The side 252 opposite surface 250 has an appropriate angle relative to surface 250 to make contact with and adhesively or otherwise fasten to end 244 of spring 246. Side 252 may itself be angled to reduce the thickness of contact member 242, particularly near the end 254 opposite spring 246.

A further alternate embodiment 228'''' of the lip forcing mechanism is shown in FIG. 10. Embodiment 228'''' includes two sets of pairs of contact members 242'''', each pair of which is adjustably attached to an opposite one of extensions 32''''. Each contact member 242'''' has an appropriate shape to reach from attachment to extension 32'''' around the side of the wearer's face to make contact at the appropriate location in the region of the upper or lower lip on one side or the other. Each set of contact members 242'''' has a slot 256 into which the edge of extension 32'''' fits. A set screw 258 is used to fasten or loosen the set of contact members 242'''' with respect to extension 32''''. When screw 258 is loose, contact members 242'''' may be moved toward or away from the wearer's face. When an appropriate force is being applied by contact members 242'''' to the face, screw 258 is tightened to maintain such force. Preferably, contact members 242'''' are somewhat yieldable.

In use, a person receives mouthpiece 26 in his mouth and places members 92 between his teeth. His lips naturally fit about portion 84, and it is important that the person keeps his lips in contact with portion 84 to maintain a seal. Straps 36 and 38 are moved over the top of the person's head and adjusted for comfort. Strap 38 may be located quite low on the head or neck, while strap 36 may be located quite high on the head or even at the very top of the head. Nose clip 126 is removed from ledge 122 and functioned appropriately to clamp the person's nose closed.

During breathing, on inhalation air is drawn through the openings in cover 46 for cleaning or filtering by filter element 42. The filtered air is directed through aligned openings 48 and 50 and along walled passageway 30 to common chamber 66. Since a negative pressure develops in space 152, closure members 148 flex to open opening 142 and allow the filtered air to flow into space 152 keeps second valve mechanism 74 closed.

On exhalation, air flows directly from the mouth through connecting passageway 98 and space 152 to second valve mechanism 74. The overpressure in space 152 causes closure member 106 to flex and allow air to pass through opening 100 and thereafter through openings 112 in cover 110 to reach the ambient atmosphere. The overpressure in space 152 keeps valves 140 closed.

The indicated process continues as breathing continues.

As has been indication hereinbefore, with an embodiment of the present invention which includes chin support mechanism 190, a force may be applied to counter the force applied by straps 36 and 38 so as to minimize any force at mouthpiece 26. In order to provide for the most comfort with respect to the balancing of these forces, support member 194 may be adjusted by turning thumb screw 214 as appropriate.

As an alternate to chin support 190, one of various forcing mechanisms may be used. In the case of mechanism 228'', fingers 238 include a ductal member 240 to allow each of the fingers to be somewhat reshaped to apply an appropriate force against the upper or lower lips. In the case of mechanism 228'''', screws 258 may be loosened so that contact members 248'''' may be moved to apply appropriate force. Screws 258 are then again tightened.

The present invention includes a number of features which result in a comfortable respiratory protective device and one in which seal integrity is likely to be maintained. Alternatives to various features have been pointed out. It is understood, however, that many other equivalents are available. In that regard, it is understood that changes made, especially in matters of shape, size and arrangement of various components and structure to the full extent extended by the general meaning of the terms in which the appended claims are expressed, are within the principle of the present invention.

What is claimed is:

1. A respiratory protective device for a person, comprising:

a mouthpiece having an opening means for centering with respect to the person's mouth, said mouthpiece having a centerline extending centrally through the opening means;

means for holding said mouthpiece with respect to the person's head;

a plurality of filter assemblies for filtering air;

means, attached to said holding means, for directing the filtered air from said filter assemblies to said mouthpiece, and supporting said filter assemblies and said mouthpiece, said directing means including first and second chambers;

said first chamber containing said second chamber, said mouthpiece being connected to said second chamber, said directing means also including a plurality of passageways, each passageway connected between a different one of the filter assemblies and said first chamber wherein each of said passageways is in fluid communication with said first chamber and a different one of said filter assemblies; and said directing means further including means for selectively passing filtered air and exhalation air, and defining with the remainder of said directing means said first and second chambers, said passing means including first valve means, positioned between the first and second chambers, for admitting filtered air from said first chamber to said second chamber to flow to said mouthpiece and second valve means positioned between the second chamber and the atmosphere opposite the mouthpiece and adjacent to said first valve means, for minimizing dead air space, and directly outletting exhalation air from said mouthpiece and said second chamber to ambient.

2. The device in accordance with claim 1 wherein said directing means includes at least a pair of hollow tubes, including rigid walls, forming said passageways therein connected between said filter assemblies and said first chamber.

3. The device in accordance with claim 2 wherein said holding means includes a pair of strap means for extending from said device, around said person's head, and back to the device.

4. The device in accordance with claim 3 wherein said holding means includes means for orienting one of said strap means at an angle up to 90 degrees with respect to the other so that said one strap means may extend over the top of the person's head while said other strap means may extend around behind the person's head.

5. The device in accordance with claim 1 wherein said first chamber includes rigid, opposite fore and aft walls, said second valve means being attached to said fore wall, said mouthpiece being attached to said fore wall, said passing means including a transverse wall enclosing a portion of space between said fore and aft walls, said transverse, fore and aft walls defining said second chamber, said first valve means including a closeable opening, communicating through the passageways and filters with the atmosphere, mounted in said transverse wall.

6. The device in accordance with claim 5 wherein said first valve means includes a flexible member attached to the transverse wall over the opening on the side thereof adjacent the second chamber for openably closing said opening in said transverse wall so as to flex away from said opening when filtered air flows through said first chamber toward said mouthpiece and to close said opening when exhalation air flows away from said mouthpiece through said second chamber toward said second valve means.

7. The device in accordance with claim 5 wherein sad first valve means includes a plurality of regularly spaced closeable openings in said transverse wall, said second valve means having a centerline which is coaxial with said centerline of said mouthpiece.

8. A respiratory protective device for a person, comprising:

a mouthpiece with a centerline;

first and second spaced apart canister means adapted for positioning on opposite sides of the mouthpiece with an air filter in each;

means for directing filtered air from said filter means to said mouthpiece, said directing means including a rigid frame, said rigid frame including a through passageway having opposite ends, and connected midway between its ends to the mouthpiece and connected to said first canister at one end of the passageway and to said second canister at the other end, said directing means further including means attached to said passageway for selectively passing filtered air from said filters to said mouthpiece and exhalation air from said mouthpiece to ambient;

means, attached to said frame, for holding said protective device on the person, exerting a first force directed toward pushing said mouthpiece into the person's teeth and gums; and reaction means, attached to said frame, for exerting a second force in a direction generally counter to said first force to relieve the person's teeth and gums from said first force when said device is operably worn by the person, and contacting the person's face external of the person's mouth.

9. The protective device in accordance with claim 8 wherein said reaction means includes a support member spaced beneath said mouthpiece and extending generally parallel to the centerline of said mouthpiece, said reaction means further including means for attaching said support member to said frame, said support member being adapted to contact the person's face generally beneath the person's lower lip.

10. The protective device in accordance with claim 9 wherein said reaction means further includes means for adjusting said support member's position in a direction generally parallel to the centerline of the mouthpiece.

11. The protective device in accordance with claim 10 wherein said attaching means includes a guide block fixedly attached to said frame, said guide block including a plurality of through passageways, said support member including a plurality of guide posts which mate with said passageways, one of said guideposts including a threaded passageway, said adjusting means including a threaded bolt retained by said guide block, said bolt is threaded into said threaded passageway of said one guide post of said support member, whereby rotation of said bolt moves said support member with respect to said guide block and in said generally parallel direction while said other guide posts maintain directional alignment.

12. The device in accordance with claim 8 wherein said reaction means includes means for forcing the person's lips closed around said mouthpiece.

13. A respiratory protective device for a person, comprising:

a mouthpiece with a centerline;

a canister with an air filter therein;

means for directing air from said canister to said mouthpiece, said directing means including a passageway between said canister and said mouthpiece, and a rigid frame defining said passageway, said mouthpiece being attached to said passageway, said directing means also including means attached to said passageway for selectively passing filtered air from said filter to said mouthpiece and exhalation air from said mouthpiece to ambient;

means, attached to said directing means, for holding said protective device on the person's head, said holding means being attached to the frame and including means for extending from said frame around the back of the person's head and back to said frame, said holding means also including means rigidly attached to said frame for rigidly engaging the person's chin such that movement by the person of his/her chin causes said engaging means and said mouthpiece to move correspondingly therewith, said engaging means including a support member spaced beneath said mouthpiece, said engaging means further including means for adjusting said support member's position in a direction parallel to the centerline of the mouthpiece, said engaging means including a guide block fixedly attached to said frame, said guide block including a plurality of through passageways, said support member including a plurality of guide posts which mate with said passageways, one of said guideposts including a threaded passageway, said adjusting means including a threaded bolt retained by said guide block, said bolt is threaded into said threaded passageway of said one guide post of said support member, whereby rotation of said bolt moves said support member with respect to said guide block and in said generally parallel direction while said other guide posts maintain direction alignment.

* * * * *